US005351513A

United States Patent [19]

Ellis

[11] Patent Number: 5,351,513

[45] Date of Patent: Oct. 4, 1994

[54] DOUBLE CYLINDER DEADBOLT

[75] Inventor: Philip C. Ellis, Reading, Pa.

[73] Assignee: Baldwin Hardware Corporation, Reading, Pa.

[21] Appl. No.: 24,568

[22] Filed: Mar. 1, 1993

[51] Int. Cl.[5] ..... E05B 9/10

[52] U.S. Cl. ..... 70/370; 70/381; 70/452; 70/DIG. 57; 70/DIG. 60

[58] Field of Search ..... 70/370, 452, DIG. 60, 70/DIG. 57, 449, 371, 451, 381, 416, 417, DIG. 63

[56] References Cited

U.S. PATENT DOCUMENTS

| | | | |
|---|---|---|---|
| 165,644 | 7/1875 | Winn | 70/370 |
| 409,246 | 8/1889 | Severance | 70/381 |
| 971,333 | 9/1910 | Weed | 70/370 |
| 1,461,756 | 7/1923 | Croning | 70/449 |
| 1,479,658 | 1/1924 | Freysinger | 70/381 |
| 3,212,308 | 10/1965 | Eads | 70/370 |
| 3,550,411 | 12/1970 | Neary et al. | 70/370 |
| 3,869,890 | 3/1975 | Neary | 70/DIG. 60 X |
| 4,073,172 | 2/1978 | Schlage | 70/370 X |
| 4,548,061 | 10/1985 | Nilsson | 70/DIG. 57 X |
| 4,593,546 | 6/1986 | Allen | 70/370 X |

FOREIGN PATENT DOCUMENTS

| | | | |
|---|---|---|---|
| 328198 | 10/1920 | Fed. Rep. of Germany | 70/DIG. 60 |
| 91499 | 11/1921 | Switzerland | 70/451 |
| 177900 | 9/1935 | Switzerland | 70/452 |
| 2200680 | 8/1988 | United Kingdom | 70/370 |
| 2216944 | 10/1989 | United Kingdom | 70/370 |

*Primary Examiner*—Lloyd A. Gall

*Attorney, Agent, or Firm*—Myron B. Kapustij; Malcolm L. Sutherland

[57] ABSTRACT

A double cylinder tubular deadbolt having the inside cylinder provided with a removeable cap or cover which covers the exposed screws in the flanged face of the inside cylinder. The removable cover fits over and covers the face portion of the inside cylinder. The cover is retained in place by an escutcheon which fits over the flanged face with the cover thereon.

20 Claims, 3 Drawing Sheets

DOUBLE CYLINDER DEADBOLT

Field of the Invention

This invention relates to locks, more particularly to the class of locks known as double cylinder tubular deadbolts.

BACKGROUND OF THE INVENTION

This invention is directed to locks known as double cylinder tubular deadbolts. These devices are generally used in situations where it is possible to reach the lock from outside by breaking a window, and they require a key to be unlocked from either side.

Virtually all such locks conform to a conform to a method of installation for the cylinders. The inside and outside each have a cylinder (or composite cylinder/-housing) with a flanged face and a collar or escutcheon with a bore that accepts the cylinder body and a counterbore to accept the flanged face. The outside cylinder has two blind holes drilled and tapped from the back and the inside cylinder has matching holes drilled through. The cylinders are installed by sliding each cylinder into its respective collar, placing them over the hole bored through the door, then sliding screws through the holes in the inside cylinder and threading them into the holes in the outside cylinder. When the screws are tightened the assembly can't be removed without tools, effectively preventing simple entry even if access can be gained to the inside of the door. If security is especially critical the inside cylinder may be fitted with screws theft require special tools for removal or small screw covers may be pushed into counterbores around the screw head, preventing access to the screw head without first prying out the screw cover. Removal of the screw covers invariably ruins them, so if cylinders have to be removed, as for painting, new covers must be purchased to complete the reinstallation. Furthermore, exposed screws, whether covered or not, are generally considered to detract from the appearance of installation.

The present invention solves these problems.

SUMMARY OF THE INVENTION

In accordance with the instant invention there is provided an inside lock cylinder assembly including a cap or cover to cover the exposed screw heads in the flanged face of the inside cylinder of a double cylinder tubular deadbolt. The inside lock cylinder assembly comprises a lock cylinder, including a cylinder plug, having a body portion and an enlarged diameter flanged face portion; a collar having an externally threaded portion and a bore that accepts the body portion of the lock cylinder; a cap or cover adapted to fit over and cover the face portion of the lock cylinder; and an escutcheon having a bore, a portion of which is internally threaded, adapted to accept the flanged face with the cover thereon. The escutcheon is screwed onto the collar thereby securing the cap between the face and the escutcheon.

The cylinders are installed by sliding the outside cylinder into its outside escutcheon and then placing it over a hole bored through the door on the outside of the door; sliding the inside cylinder into the collar and placing it over the hole bored through the door on the inside of the door; sliding screws through screw holes in the inside cylinder and threading them into blind screw holes in the outside cylinder; placing the cap over the flanged face of the inside cylinder; and sliding the inside escutcheon over the flanged face and screwing it onto the collar thereby securing the cap to the face.

Detailed Description of the Preferred Embodiment

Figure 1:
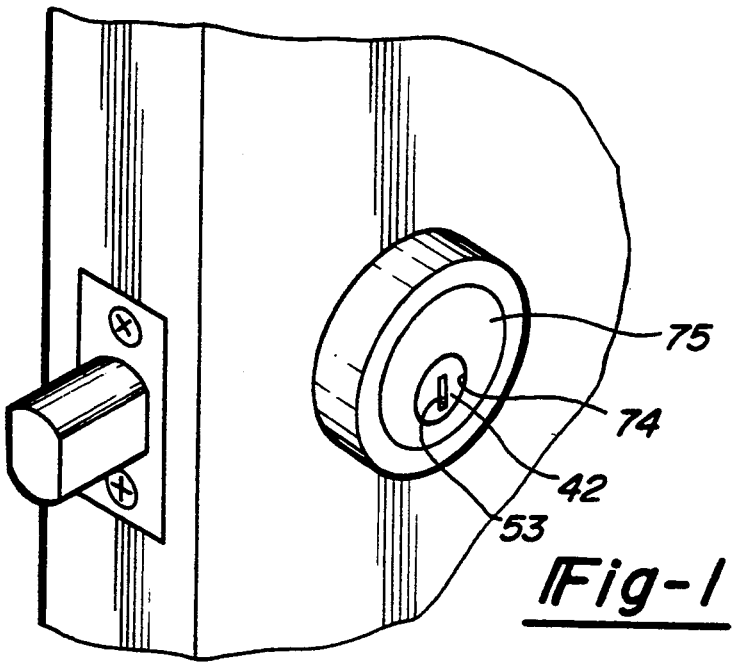
FIG.1 is a perspective view of a door with the inside lock cylinder assembly and escutcheon in an assembled position mounted in the door.

In one embodiment of the present invention there are provided two lock cylinder assemblies, an inside lock cylinder assembly 10 and an outside lock cylinder assembly 110. The inside cylinder assembly 10 includes an inside lock cylinder 40. The outside lock cylinder assembly includes outside lock cylinder 140. The inside lock cylinder 40 includes a cylinder plug 42 from which extends a tailpiece 44. Tailpiece 44 engages door latch assembly 210 which is of well known and conventional design. The cylinder plug 42, which is of conventional and known design, rotates in axially extending opening 53 in cylinder housing 41. In the embodiment illustrated in the drawings the housing 41 has a generally cylindrical shaped body portion 48 and an enlarged diameter flanged face portion 47 at the front end of the body portion 48. In the embodiment illustrated in the drawings body portion 48 has an axially extending slot 49 adopted to receive tooth 22 of cylinder housing collar 20. With tooth 22 disposed in slot 49 the inside lock cylinder assembly 40 and cylinder housing collar 20 are locked together against rotational movement relative to each other, and being locked to cylinder 40 the collar 20 does not rotate with escutcheon 80. This allows the escutcheon 80 to be screwed onto or unscrewed from collar 20 if it is desired to remove the lock cylinder 40. It is also possible to lock cylinder 40 and collar 20 against rotation by providing a body portion 48 which has a non-cylindrical profile, e.g., square, triangular, etc., and a collar 20 that has complementary shaped bore.

In circumstances where extra security is desired the collar 20 need not be locked against rotation to lock cylinder 40. This results in collar 20 and escutcheon 80 being freely rotatable with respect to each other. This makes unscrewing and removal of the escutcheon 80 and cylinder 40 extremely difficult.

Figure 2:
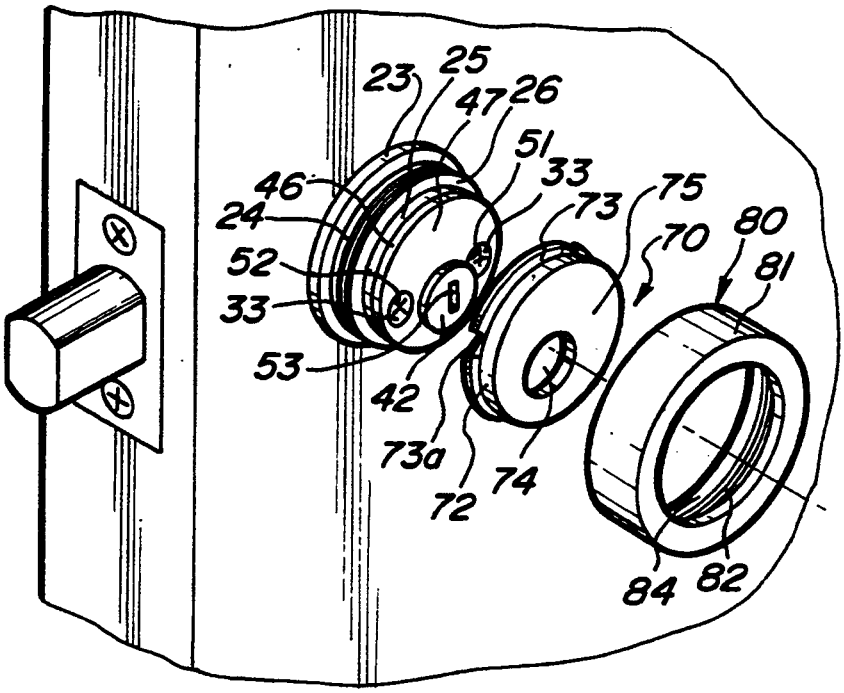
FIG. 2 is a view similar to FIG. 1 but with the face plate and escutcheon removed from the inside lock cylinder.

Openings 51 and 52 extend through the body portion 48 and the face portion 47. These openings 51 and 52 are adapted to receive fasteners such as screws 32. The screws 32 are inserted into openings 51 and 52, as illustrated in FIG. 2, and are screwed into corresponding blind screw openings in outside lock cylinder 140. Once the screws 32 are screwed into the screw openings in outside cylinder 140 the cylinder cap 70 is fitted over the face portion 47 to cover the exposed screw heads 33.

Opening 53 likewise extends through the body portion 48 and the face portion 47, and is adapted to receive cylinder plug 42.

Figures 3, 4:
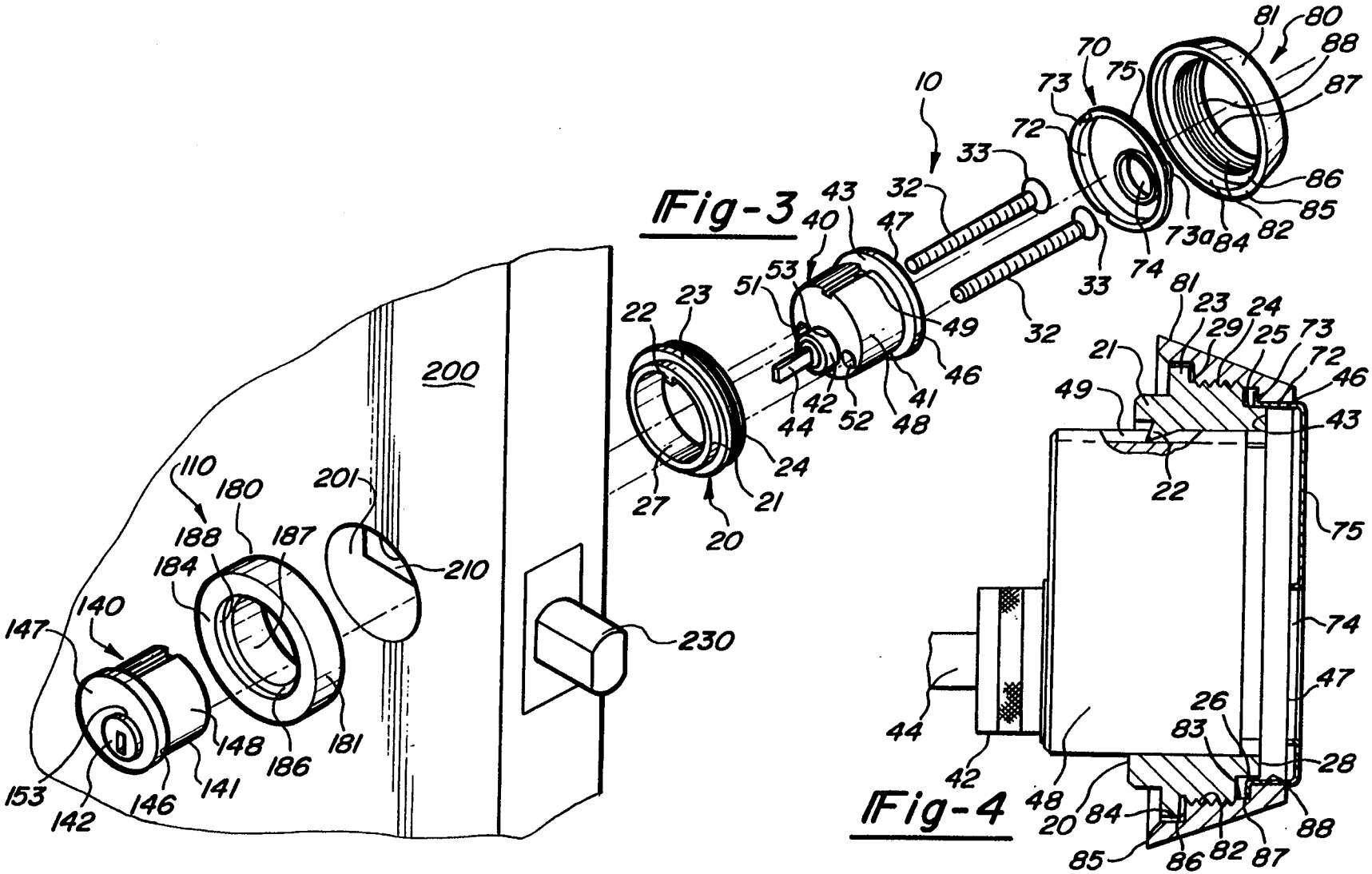
FIG. 3 is an exploded perspective view of the outside and inside lock cylinder assemblies.
FIG. 4 is a side elevational view in section of the inside lock cylinder assembly with the collar, lock cylinder, face cap and escutcheon in an assembled position. In the embodiment illustrated in this figure the escutcheon has a different exterior shape than in the embodiment illustrated in FIGS. 1–3. In this embodiment the escutcheon is frusto-conical in shape.
Figure 5:
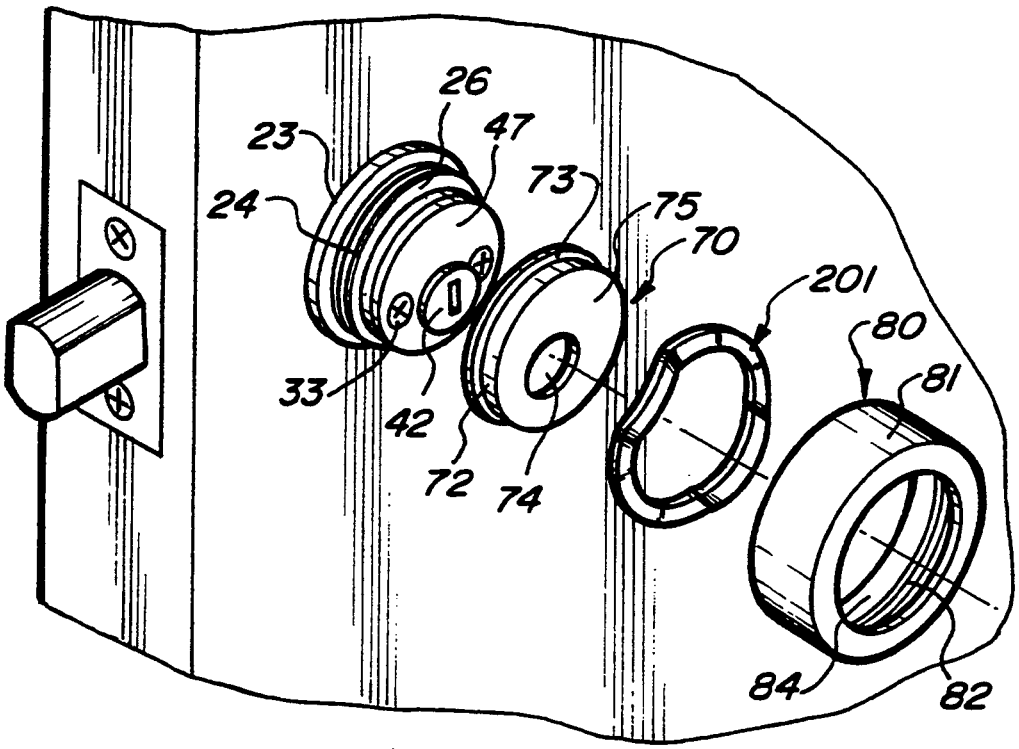
FIG. 5 illustrates a wave washer 201 with the inside lock assembly.

Cylinder cap 70 is comprised of a front wall 75, a side wall 72, and a flange 73 extending radially outward from side wall 72. In the embodiment illustrated in the drawings flange 73 is fitted with offset flexible elements ( finger springs) 73*a* which accommodate axial variations in the sizes of the other parts. The cylinder cap 70 is sized to fit over the front face portion 47 of the cylinder housing 41, i.e., when the cylinder cap 70 is mounted over the front face portion 47 of the cylinder housing 41 the side wall 72, as best illustrated in FIG. 4, fits over the rim 46 of the front face portion 47. An opening 74 is provided in the front wall 75. The opening 74 is sized to fit over that portion of cylinder plug 42 extending through the front face portion of cylinder housing 47.

The cylinder housing collar 20 fits over the body portion 48 of the cylinder housing 41. In the embodiment illustrated in the drawings the interior surface 27 of the collar 20 is generally smooth with the exception of tooth 22 which fits into groove 49 and prevents rotational movement of the collar 20 relative to the housing 40 when the collar 20 is mounted over the body portion 48 of the housing 40. The outer surface of collar 20 is generally stepped and contains a threaded section 24 adapted to engage the internally threaded section 82 of the escutcheon 80. In front of threaded section 24 is a front section 25 of reduced outer diameter having a smooth outer surface. In the embodiment illustrated in the drawings the outer diameter of front section 25 is preferably similar to the outer diameter of rim 46 of face portion 47 so that, as best illustrated in FIGS. 2 and 4, when the collar 20 is mounted on body portion 41 of cylinder housing 40 the outer surfaces of section 25 and rim 46 are substantially flush. This allows, as illustrated in FIG. 4, the side wall 72 of cap 70 to fit over both the rim 46 and part of front section 25. As also illustrated in FIG. 4 the front edge or face 28 of collar 20 abuts against the rear face of rim 46.

In the embodiment illustrated in the drawings the collar 20 includes a radially extending annular flange 23 of preferably greater diameter than threaded section 24 to the rear of section 24. In this embodiment a front shoulder 29 is formed between threaded section 24 and flange 23. In the present embodiment to the rear of flange 23 is a rear section 21 preferably of reduced outer diameter. The rear section 21 is preferably adapted to be inserted into opening 201 extending through door 200.

The escutcheon 80 is preferably radially symmetrical and is comprised of side wall 81 of arbitrary shape and texture. In the embodiment illustrated in the drawings side wall 81 has a smooth outer surface. The escutcheon 80 is threadedly engaged with the collar 20 by means of internally threaded section 82 engaging external threaded section 24 of collar 20. In the embodiment illustrated in the drawings a front section 88 is disposed in front of threaded section 82. In this embodiment, as best illustrated in FIG. 4, threaded section 82 does not extend up to front section 88 but is separated therefrom by smooth section 83. An annular shoulder 87 is formed by front section 88 and smooth front section 83. As illustrated in FIG. 4 the cylinder cap 70 is locked in place to the face portion 47 of cylinder housing 41 by shoulder 87 abutting against flange 73, thereby securing the cap against face portion 47. In the embodiment illustrated in the drawings raised flexible elements 73*a* accommodate variations in the dimensions of the assembled parts. A washer, such as wave washer, may be disposed intermediate the radially extending flange 73 and shoulder 87. In the embodiment illustrated in the drawings located to the rear of the internally threaded section 82 is a smooth back section 84. Section 84 has a larger inner diameter than section 82, thereby forming shoulder 86 with section 82. Section 84 is adapted to receive flange 23 of collar 20.

The back rim 85 of wall 81 of escutcheon 80 has a larger diameter than the diameter of opening 201 in door 200. Thus, the back rim 85 of escutcheon 80 abuts against the surface of The door and the escutcheon 80 is disposed on the outside of the door 200.

The lock cylinder 140 is generally similar to lock cylinder 40. It includes a cylinder housing 141 into which is inserted a cylinder plug 142 via axially extending opening 153. From the rear of cylinder plug 142 extends a tailpiece (not shown) similar to tailpiece 44. The tailpiece engages door latch assembly 210. In the embodiment illustrated in the drawings the housing 141 has a generally cylindrical shaped body portion 148 and an enlarged diameter face portion 147 having rim 146 at the front end of the body portion 148.

Two blind screw openings (151, 152) are disposed only in the body portion 148. These screw openings are adapted to receive screws 32. In a preferred embodiment of the instant invention screw openings 51 and 52 in cylinder housing 41 are smooth while screw openings 151 and 152 in cylinder housing 141 are internally threaded. Thus, screws 32 are merely slid through openings 51 and 52, and are screwed into threaded openings 151 and 152.

The lock cylinder 140 is adapted to be inserted into escutcheon 180. Escutcheon 180 is comprised of side wall 181. The interior of side wall 181 is stepped and comprised of a front section 188 and a rear section 187. Rear section 187 has a smaller inner diameter than front section 188. A shoulder 186 is formed by front section 188 and rear section 187.

Body portion 148 of cylinder housing 141 is sized to fit within rear section 187 of escutcheon 180 and has a smaller diameter than rear section 187. The face portion 147 of cylinder housing is sized to fit within front section 188 of escutcheon 180 and has an outer diameter which is smaller than the inner diameter of front section 188. However, the outer diameter of face portion 147 is larger than the inner diameter of rear section 187. Thus, the back side of face portion abuts against shoulder 186 and is prevented from entering rear section 187. Furthermore, the height of rim 146 is generally similar to the height of front section 188. This results in the face portion 147 being substantially flush with the front edge 189 of the escutcheon 180 when the lock cylinder assembly 140 is inserted into the escutcheon 180.

In assembling the cylinder assemblies of the instant invention the cylinder housing collar 20 is slid onto lock cylinder 40 with tooth 22 engaged in slot 49. The screws 32 are then inserted through openings 51 and 52 and screwed into corresponding openings in body portion 148 of lock cylinder 140. The cylinder cap 70 is then placed over the face portion 47, and the escutcheon 80 is screwed onto collar 20 thereby locking cylinder cap 70 in place.

Having described my invention, in terms of a preferred embodiment, numberous modifications will now occur to persons skilled in the art. I do not wish to be limited in the scope of my invention except as claimed.

What is claimed is:

1. A door containing a double cylinder deadbolt comprising:

an outside cylinder assembly comprising;

an outside cylinder having a face and a body portion and including at least one blind opening in said body portion adapted to receive at least one fastener, and an outside escutcheon having a bore therethrough adapted to fit over said outside cylinder; and an inside cylinder assembly connected to said outside cylinder assembly by said at least one fastener comprising;

an inside cylinder having a flanged face and a body portion and including at least one opening extending through said body portion and said face adapted to receive said at least one fastener;

a collar having a bore adapted to fit over at least said body portion of said inside cylinder, an inside escutcheon having a bore therethrough adapted to fit over said inside cylinder and collar, said bore of said escutcheon including an internal shoulder, and a removable cap adapted to fit over and cover at least part of the face of said inside cylinder and conceal said at least one fastener, said cap including a radially extending flange adapted to abut against said internal shoulder of said inside escutcheon.

2. The door of claim 1 wherein at least a section of said bore of said inside escutcheon is internally threaded, and wherein at least a section of said collar is externally threaded, whereby said escutcheon is adapted to be screwed onto said collar.

3. The door of claim 2 wherein said collar and said inside cylinder body portion contain means for locking the collar to said inside cylinder against rotational movement of said collar relative to said inside cylinder.

4. The door of claim 3 wherein said means comprise a tooth extending radially inwardly on said collar and an axially extending slot on said inside cylinder body portion adapted to receive said tooth.

5. The door of claim 3 wherein said means comprise said inside cylinder body portion having a non-cylindrical shape and said collar having a complementary shaped bore.

6. The door of claim 1 wherein said radially extending flange has raised flexible fingers that bear on said shoulder of said inside escutcheon to compensate for variations in the axial dimensions of said inside cylinder assembly.

7. The door of claim 1 wherein a washer is disposed intermediate said radially extending flange and said shoulder of said inside escutcheon.

8. The door of claim 7 wherein said washer is a wave washer.

9. The door of claim 1 wherein said at least one fastener is a threaded fastener.

10. The door of claim 9 wherein said threaded fastener is a screw or a bolt.

11. A double cylinder deadbolt comprising:

an outside cylinder assembly comprising;

an outside cylinder having a flanged face and a body portion, and including at least one blind opening in said body portion adapted to receive at least one fastener, and an outside escutcheon having a bore therethrough adapted to fit over at least said body portion and a counterbore adapted to fit over said flanged face;

an inside cylinder assembly comprising;

an inside cylinder having a flanged face and a body portion, and including at least one opening extending through said body portion and said face adapted to receive said at least one fastener, a collar having a bore adapted to fit over at least said body portion of said inside cylinder, an inside escutcheon having a bore therethrough adapted to fit over said collar and said inside cylinder, said bore of said escutcheon including an internal shoulder, and a removable cap adapted to fit over and cover at least part of the face of said inside cylinder and conceal said at least one fastener, said cap including a radially extending flange adapted to abut against said internal shoulder of said inside escutcheon.

12. The deadbolt of claim 11 wherein at least a section of said bore of said inside escutcheon is internally threaded, and wherein at least a section of said collar is externally threaded, whereby said escutcheon is adapted to be screwed onto said collar.

13. The deadbolt of claim 12 wherein said collar and said inside cylinder body portion contain means for locking the collar to said inside cylinder against rotational movement of said collar relative to said inside cylinder.

14. The deadbolt of claim 13 wherein said means comprise a tooth extending radially inwardly on said collar and an axially extending slot on said inside cylinder body portion adapted to receive said tooth.

15. The deadbolt of claim 13 wherein said means compromise said inside cylinder body portion having non-cylindrical shape and said collar having a complementary shaped bore.

16. The deadbolt of claim 11 wherein said radially extending flange has raised flexible fingers that bear on said shoulder of said inside escutcheon to compensate for variations in the axial dimensions of said inside cylinder assembly.

17. The deadbolt of claim 11 wherein a washer is disposed intermediate said radially extending flange and said shoulder of said inside escutcheon.

18. The deadbolt of claim 17 wherein said washer is a wave washer.

19. The deadbolt of claim 11 wherein said fastener is a threaded fastener.

20. The deadbolt of claim 19 wherein said threaded fastener is a screw or bolt.

* * * * *